US007980452B2

(12) United States Patent
Burton

(10) Patent No.: US 7,980,452 B2
(45) Date of Patent: Jul. 19, 2011

(54) COVERED CONTAINER FOR ENCLOSING A FOOD PRODUCT OR THE LIKE

(75) Inventor: Jack Burton, Reno, TX (US)

(73) Assignee: Paris Packaging, Inc., Paris, TX (US)

( * ) Notice: Subject to any disclaimer, the term of this patent is extended or adjusted under 35 U.S.C. 154(b) by 50 days.

(21) Appl. No.: 12/537,765

(22) Filed: Aug. 7, 2009

(65) Prior Publication Data

US 2010/0032475 A1 Feb. 11, 2010

Related U.S. Application Data

(60) Provisional application No. 61/087,300, filed on Aug. 8, 2008.

(51) Int. Cl.
*B65D 5/20* (2006.01)
*B65D 5/66* (2006.01)

(52) U.S. Cl. ..... 229/114; 229/146; 229/148; 229/902

(58) Field of Classification Search ..... 229/114, 229/145, 146, 148, 902, 906, 125.26, 125.28, 229/125.32
See application file for complete search history.

(56) References Cited

U.S. PATENT DOCUMENTS

| | | | | |
|---|---|---|---|---|
| 2,316,457 | A * | 4/1943 | Royce | 229/125.28 |
| 3,027,062 | A * | 3/1962 | Huss et al. | 229/125.28 |
| 3,343,660 | A * | 9/1967 | Bailey | 229/114 |
| 3,687,353 | A * | 8/1972 | Prystup et al. | 229/145 |
| 4,488,675 | A * | 12/1984 | von Gnechten et al. | 229/145 |
| 5,188,284 | A * | 2/1993 | Eisman | 229/146 |
| 6,092,719 | A * | 7/2000 | Capo | 229/125.28 |
| 6,935,503 | B2 * | 8/2005 | Phan | 229/125.32 |
| 2005/0263576 | A1 * | 12/2005 | Graham et al. | 229/902 |
| 2007/0194093 | A1 * | 8/2007 | Ford | 229/148 |

FOREIGN PATENT DOCUMENTS

| | | | | |
|---|---|---|---|---|
| WO | WO-93/04932 | A1 * | 3/1993 | 229/125.28 |

* cited by examiner

*Primary Examiner* — Gary E Elkins

(74) *Attorney, Agent, or Firm* — Clements Bernard PLLC; Christopher L. Bernard

(57) ABSTRACT

The present invention provides a container configured to selectively enclose a food product or the like, including: a tray including a first side wall, a second side wall, a front wall, a back wall, and a bottom that collectively define a compartment configured to hold a food product or the like, wherein the first side wall and the second side wall each include an enlarged flap; and a tapered cover including a first side wall, a second side wall, a front wall, a back wall, and a tapered top, wherein the first side wall, the second side wall, the front wall, the back wall, and the top are substantially coextensive with the tray, and wherein the first side wall and the second side wall each include an enlarged flap that is configured and positioned to interlock with the corresponding enlarged flap of the first side wall and the second side wall of the tray.

10 Claims, 6 Drawing Sheets

COVERED CONTAINER FOR ENCLOSING A FOOD PRODUCT OR THE LIKE

CROSS-REFERENCE TO RELATED APPLICATION(S)

The present non-provisional patent application/patent claims the benefit of priority of U.S. Provisional Patent Application No. 61/087,300, filed on Aug. 8, 2008, and entitled "COVERED CONTAINER FOR ENCLOSING A FOOD PRODUCT OR THE LIKE," the contents of which are incorporated in full by reference herein.

FIELD OF THE INVENTION

The present invention relates generally to a covered container for enclosing a food product or the like. More specifically, the present invention relates to a folded paperboard, corrugated, or foam container or the like having a tapered cover and interlocking tray for enclosing a food product or the like.

BACKGROUND OF THE INVENTION

Folded paperboard, corrugated, and foam containers are often used in the fast food/quick serve restaurant industry. Advantageously, such containers are relatively simple and inexpensive to manufacture, ship, store, assemble, and use, and are typically disposable. Often, it is desirable for these containers to be stacked when full, requiring a certain degree of structural integrity.

Conventional folded paperboard, corrugated, and foam containers have inadequate structural integrity. Typically, these containers have a cover that is hingedly connected to a tray, the cover closely resembling the tray, built with the sides and front of the cover slightly overlapping the sides and front of the tray. The front of the cover is selectively secured to the front of the tray via a tab and slot mechanism, for example. Essentially, structural integrity is provided only by the front and back of the tray and cover.

Thus, what is still needed in the art is a folded paperboard, corrugated, or foam container or the like that has adequate structural integrity, such that it may be stacked, etc. Preferably, this container would be relatively simple in design and inexpensive to manufacture. Folded paperboard, corrugated, and foam containers and the like are single-use items that are used by the thousands. Thus, incremental increases in material, handling, and use efficiency may lead to significant savings and/or market penetration.

BRIEF SUMMARY OF THE INVENTION

As described above, the present invention relates generally to a covered container for enclosing a food product or the like. More specifically, the present invention relates to a folded paperboard, corrugated, or foam container or the like having a tapered cover and interlocking tray for enclosing a food product or the like.

In one exemplary embodiment, the present invention provides a container configured to selectively enclose a food product or the like, including: a tray including a first side wall, a second side wall, a front wall, a back wall, and a bottom that collectively define a compartment configured to hold a food product or the like, wherein the first side wall and the second side wall each include an enlarged flap; and a tapered cover including a first side wall, a second side wall, a front wall, a back wall, and a tapered top, wherein the first side wall, the second side wall, the front wall, the back wall, and the top are substantially coextensive with the tray, and wherein the first side wall and the second side wall each include an enlarged flap that is configured and positioned to interlock with the corresponding enlarged flap of the first side wall and the second side wall of the tray. Each of the enlarged flaps of the tray is disposed substantially adjacent to the front wall of the tray and opposite the bottom. Each of the enlarged flaps of the tray includes one or more of substantially straight features, substantially arcuate features, ridges, and notches. Each of the enlarged flaps of the tapered cover is disposed substantially adjacent to the back wall of the tapered cover and opposite the top. Each of the enlarged flaps of the tapered cover includes one or more of substantially straight features, substantially arcuate features, ridges, and notches.

In another exemplary embodiment, the present invention provides a method for providing a container configured to selectively enclose a food product or the like, including: providing a tray including a first side wall, a second side wall, a front wall, a back wall, and a bottom that collectively define a compartment configured to hold a food product or the like, wherein the first side wall and the second side wall each include an enlarged flap; and providing a tapered cover including a first side wall, a second side wall, a front wall, a back wall, and a tapered top, wherein the first side wall, the second side wall, the front wall, the back wall, and the top are substantially coextensive with the tray, and wherein the first side wall and the second side wall each include an enlarged flap that is configured and positioned to interlock with the corresponding enlarged flap of the first side wall and the second side wall of the tray. Each of the enlarged flaps of the tray is disposed substantially adjacent to the front wall of the tray and opposite the bottom. Each of the enlarged flaps of the tray includes one or more of substantially straight features, substantially arcuate features, ridges, and notches. Each of the enlarged flaps of the tapered cover is disposed substantially adjacent to the back wall of the tapered cover and opposite the top. Each of the enlarged flaps of the tapered cover includes one or more of substantially straight features, substantially arcuate features, ridges, and notches.

BRIEF DESCRIPTION OF THE DRAWINGS

The present invention is illustrated and described herein with reference to the various drawings, in which like reference numbers are used to denote like container components/method steps, as appropriate, and in which.

DETAILED DESCRIPTION OF THE INVENTION

Figure 1:
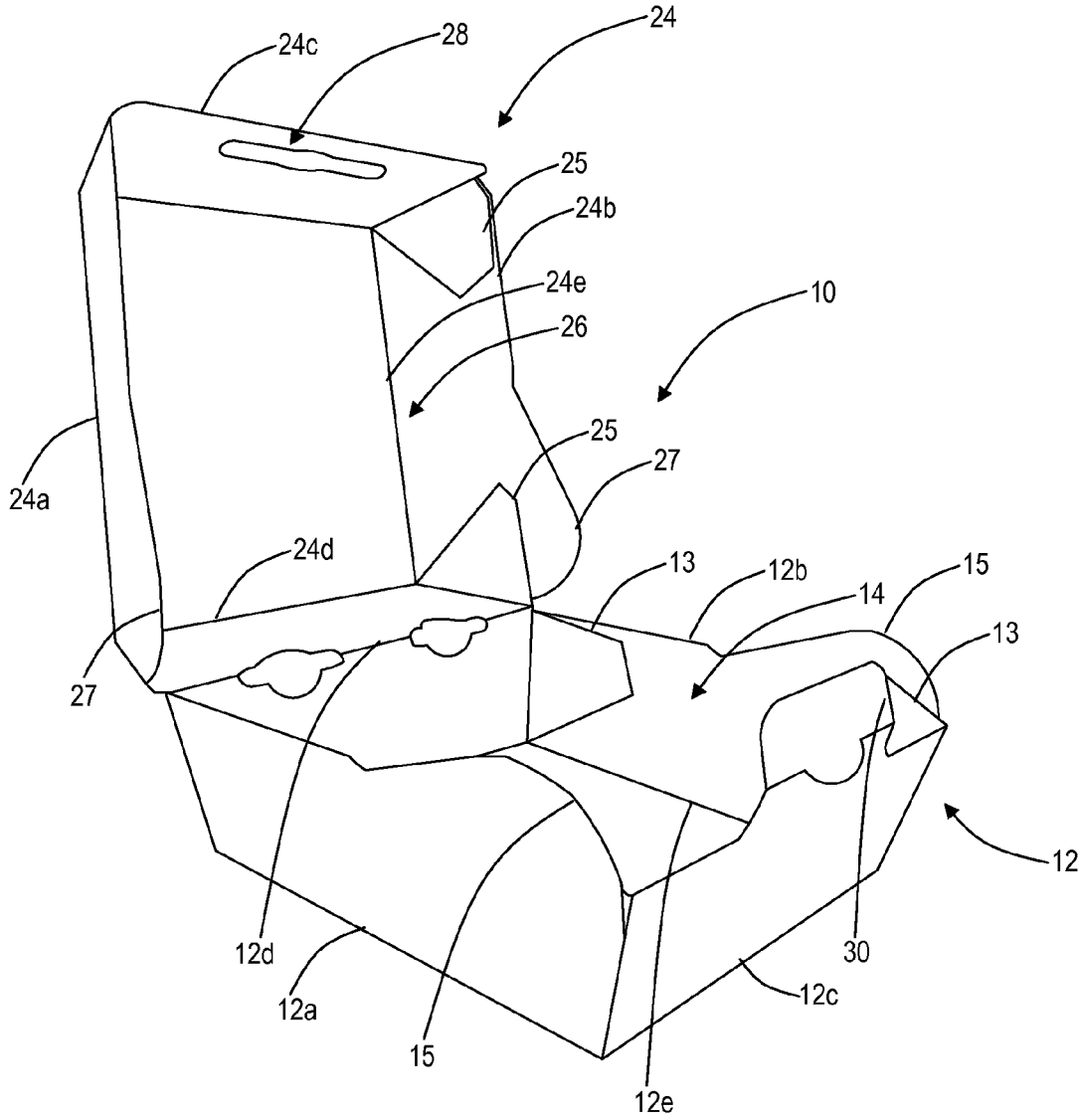
FIG. 1 is a perspective view of one exemplary embodiment of the container of the present invention in an open configuration, highlighting the tapered cover and interlocking tray.
Figure 2:
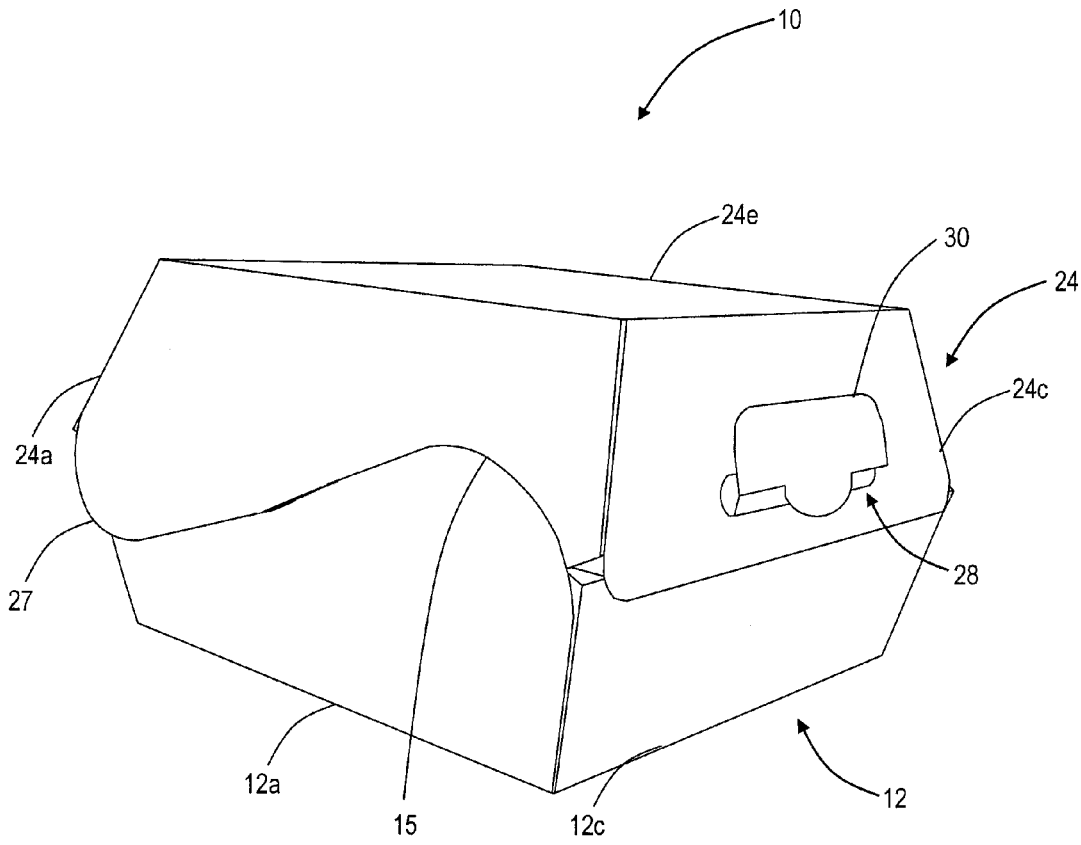
FIG. 2 is a perspective view of the container of FIG. 1 in a closed configuration, again highlighting the tapered cover and interlocking tray.
Figure 3:
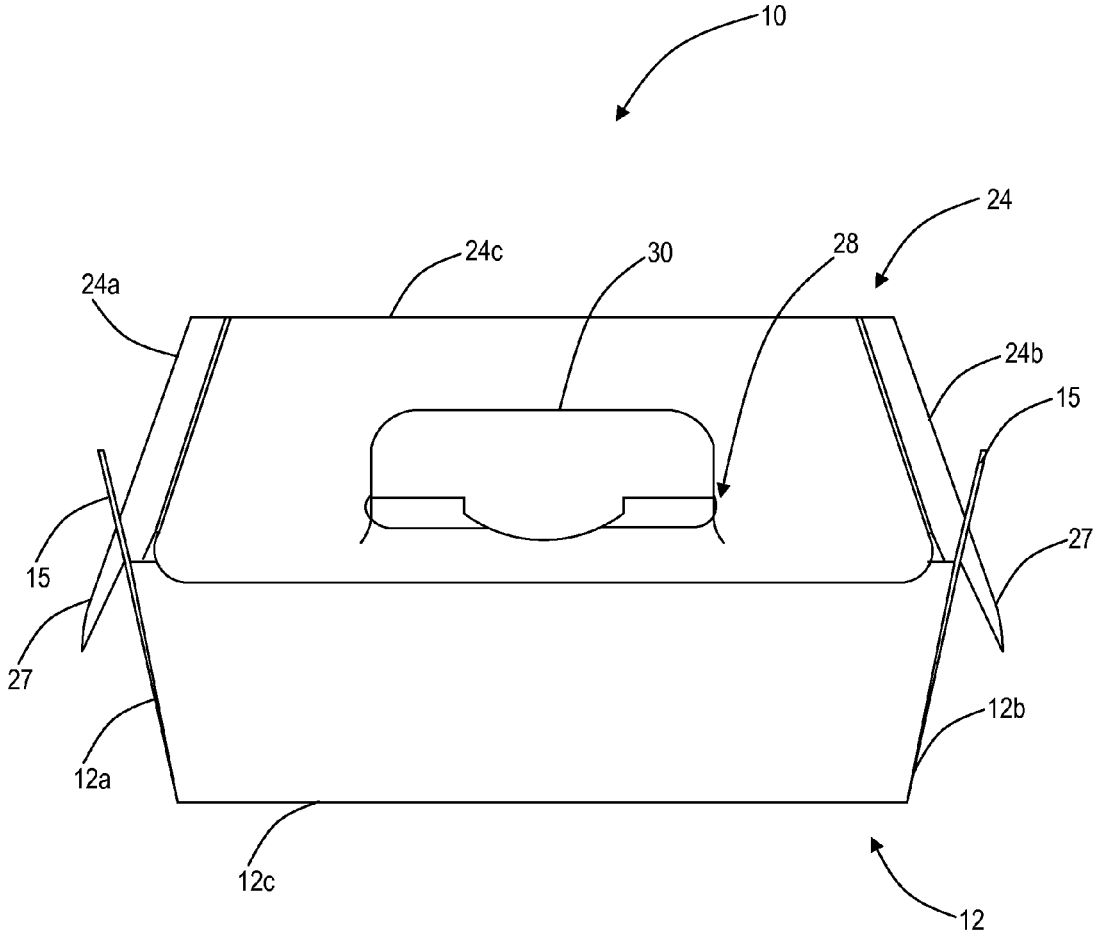
FIG. 3 is a planar front view of the container of FIGS. 1 and 2.
Figure 4:
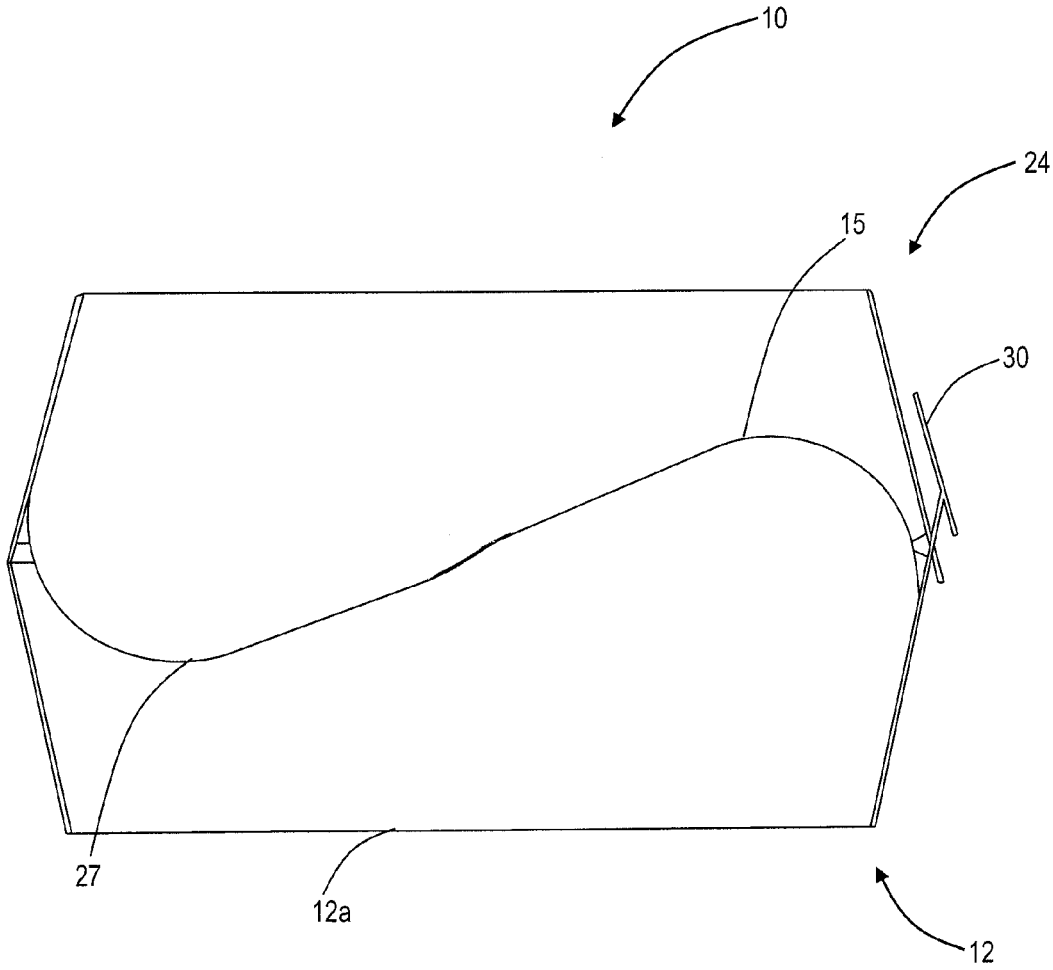
FIG. 4 is a planar side view of the container of FIGS. 1-3.
Figure 5:
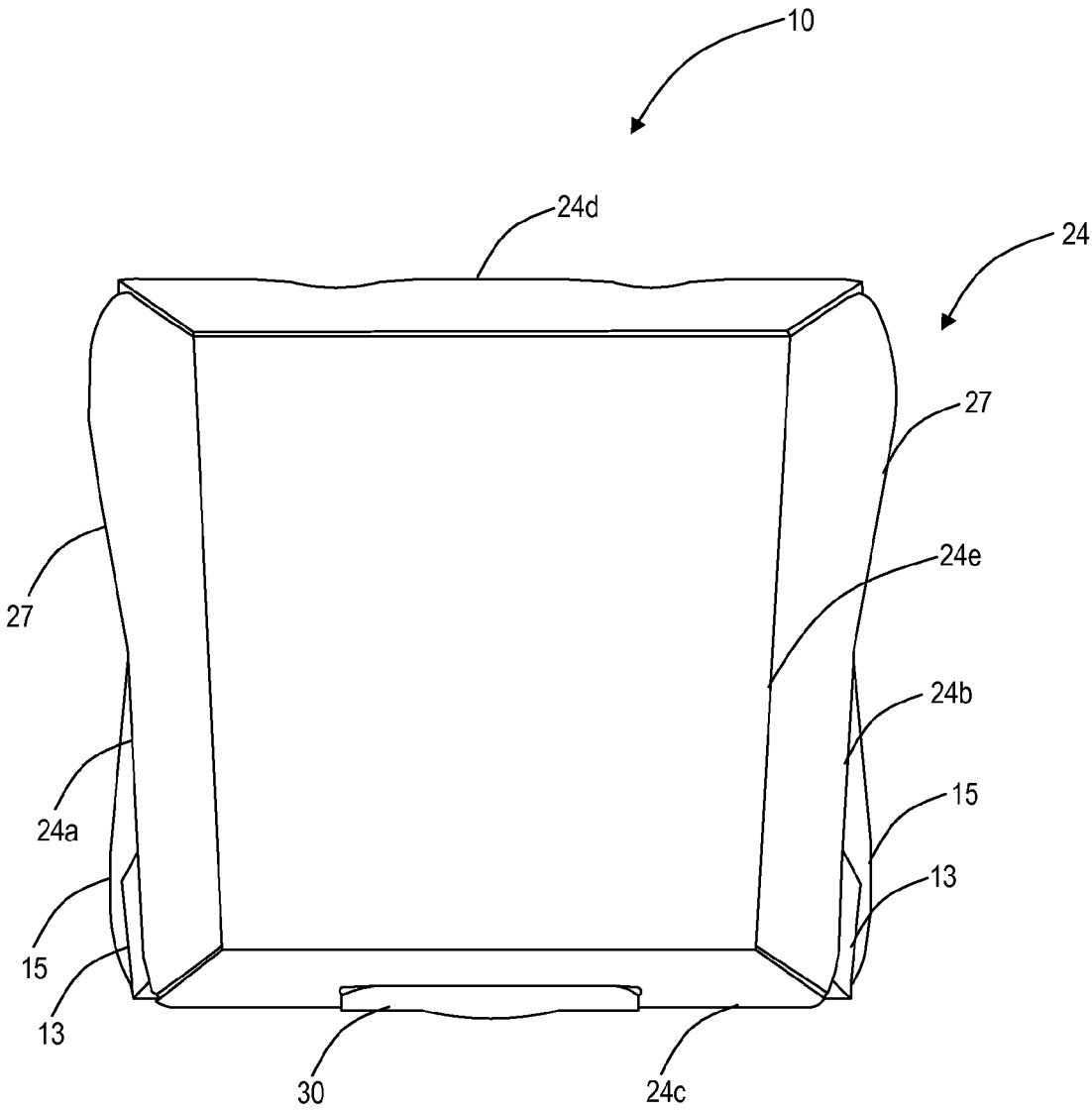
FIG. 5 is a planar top view of the container of FIGS. 1-4.
Figure 6:
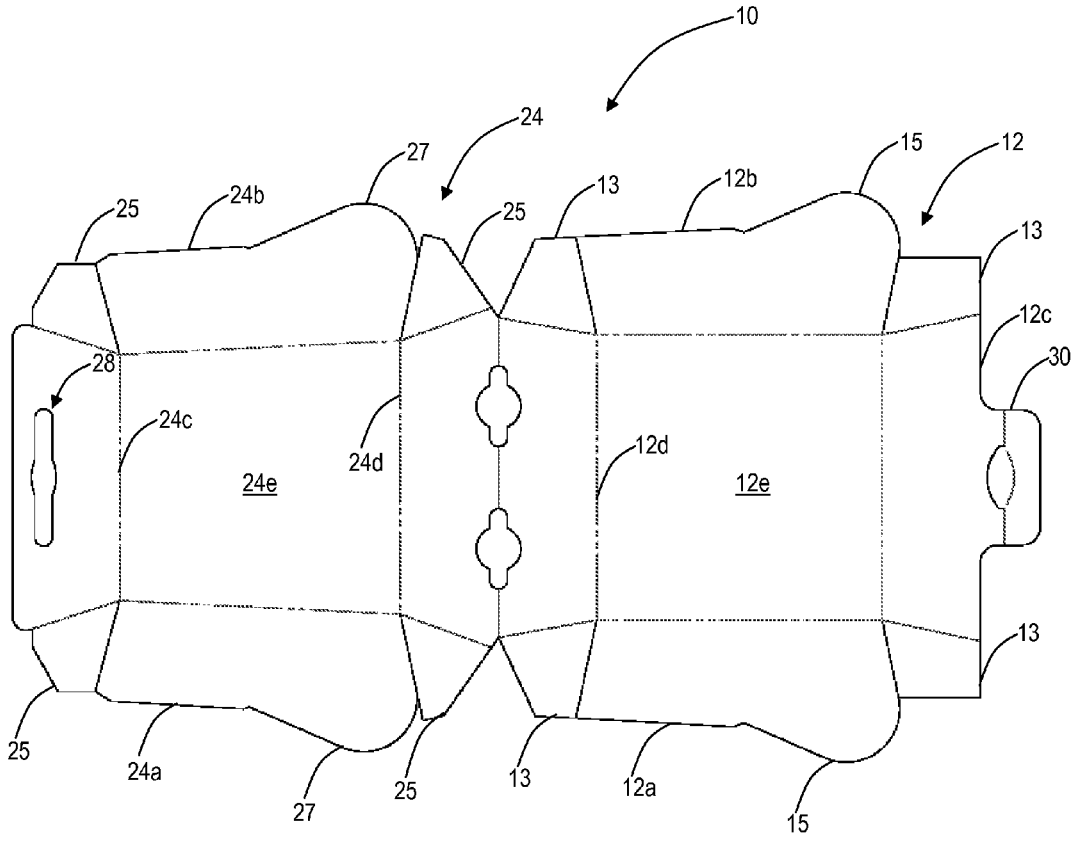
FIG. 6 is a planar top view of the container of FIGS. 1-5 in an unassembled configuration, highlighting the components of the tapered cover and interlocking tray.

Referring to FIGS. 1-6, in one exemplary embodiment, the container 10 of the present invention includes a tray 12 that is constructed from a first side wall 12*a*, a second side wall 12*b*, a front wall 12*c*, a back wall 12*d*, and a bottom 12*e*. Each of these components is made of paperboard, corrugated cardboard, styrofoam, or another suitable packaging material for food products or the like. This packaging material may be substantially, rigid, semi-rigid, or flexible, and may be dyeable, moisture resistant, heatable, etc. The first side wall 12*a*, the second side wall 12*b*, the front wall 12*c*, and the back wall 12*d* are each integrally formed with or substantially inseparable from the bottom 12*e* along multiple folds or joints. The first side wall 12*a*, the second side wall 12*b*, the front wall 12*c*, and the back wall 12*d* are connected to one another via multiple tabs 13 and corresponding slots (not illustrated) and/or an adhesive, or via a flexure joint or the like, such that the first side wall 12*a*, the second side wall 12*b*, the front wall 12*c*, the back wall 12*d*, and the bottom 12*e* collectively form a prismatic compartment 14 suitable for containing and holding a food product or the like. Preferably, the first side wall 12*a* and the second side wall 12*b* each include an enlarged flap 15 substantially adjacent to the front wall 12*c* and opposite the bottom 12*e*. These enlarged flaps 15 may include one or more substantially straight and/or substantially arcuate features, as well as one or more ridges and/or notches. The functionality of these enlarged flaps 15 is described in greater detail below.

The container 10 also includes a tapered cover 24 that selectively encloses the compartment 24 of the tray 12. The tapered cover 24 is constructed from a first side wall 24*a*, a second side wall 24*b*, a front wall 24*c*, a back wall 24*d*, and a top 24*e*. Each of these components is made of paperboard, corrugated cardboard, styrofoam, or another suitable packaging material for food products or the like. This packaging material may be substantially, rigid, semi-rigid, or flexible, and may be dyeable, moisture resistant, heatable, etc. The first side wall 24*a*, the second side wall 24*b*, the front wall 24*c*, and the back wall 24*d* are each integrally formed with or substantially inseparable from the top 24*e* along multiple folds or joints. The first side wall 24*a*, the second side wall 24*b*, the front wall 24*c*, and the back wall 24*d* are connected to one another via multiple tabs 25 and corresponding slots (not illustrated) and/or an adhesive, or via a flexure joint or the like, such that the first side wall 24*a*, the second side wall 24*b*, the front wall 24*c*, the back wall 24*d*, and the top 24*e* collectively form a prismatic compartment 26 that is substantially coextensive with the compartment 14 of the tray 12. Preferably, the top 24*e* of the tapered cover 24 is substantially tapered from the back wall 24*d* to the front wall 24*c* of the tapered cover 24. The front wall 24*c* of the tapered cover 24 includes a slot 28 that is configured to selectively engage a corresponding tab 30 associated with the front wall 12*c* of the tray 12 when the tapered cover 24 is closed, providing a sturdy closure. Preferably, the first side wall 24*a* and the second side wall 24*b* each include an enlarged flap 27 substantially adjacent to the back wall 24*d* and opposite the top 24*e*. These enlarged flaps 27 may include one or more substantially straight and/or substantially arcuate features, as well as one or more ridges and/or notches. These enlarged flaps 27 of the tapered cover 24 are configured and positioned to engage and nest with the enlarged flaps 15 of the tray 12 when the tapered cover 24 is closed. The tapered cover 24 is coupled to the tray 12 via a fold hinge or the like between the back wall 24*c* of the tapered cover 24 and the back wall 12*c* of the tray 12, which may be integrally formed or substantially inseparable.

Advantageously, the taper of the top 24*e* and the interlocking enlarged flaps 15 and 27 provide the container 10 with enhanced structural strength and integrity, such that multiple containers 10 may be stacked and manipulated without damage. Essentially, structural integrity is provided by the front walls 12*c* and 24*c*, back walls 12*d* and 24*d*, and side walls 12*a*, 12*b*, 24*a*, and 24*b* of the tray 12 and tapered cover 24. Structural integrity is also provided by the fact that the front wall 24*c* of the tapered cover 24 rests on the front wall 12*c* of the tray 12 when the tapered cover 24 is closed.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A container configured to selectively enclose a food product or the like, comprising:

a tray comprising a first side wall, a second side wall, a front wall, a back wall, and a bottom that collectively define a compartment configured to hold a food product or the like, wherein the first side wall and the second side wall of the tray each comprise an enlarged flap that protrudes above the first side wall, the second side wall, the front wall, and the back wall of the tray; and a tapered cover comprising a first side wall, a second side wall, a front wall, a back wall, and a top tapered along the first and second cover side walls, wherein the first side wall, the second side wall, the front wall, the back wall, and the tapered top of the tapered cover are substantially coextensive with the tray, and wherein the first side wall and the second side wall of the tapered cover each comprise an enlarged flap that protrudes below the first side wall, the second side wall, the front wall, and the back wall of the tapered cover and that is configured and positioned to interlock with the corresponding enlarged flap of the first side wall and the second side wall of the tray, wherein the enlarged flaps of the tray and the corresponding enlarged flaps of the tapered cover interlock in a side by side configuration.

2. The container of claim 1, wherein each of the enlarged flaps of the tray is disposed substantially adjacent to the front wall of the tray and opposite the bottom.

3. The container of claim 1, wherein each of the enlarged flaps of the tray comprises one or more of substantially straight features, substantially arcuate features, ridges, and notches.

4. The container of claim 1, wherein each of the enlarged flaps of the tapered cover is disposed substantially adjacent to the back wall of the tapered cover and opposite the top.

5. The container of claim 1, wherein each of the enlarged flaps of the tapered cover comprises one or more of substantially straight features, substantially arcuate features, ridges, and notches.

6. A method for providing a container configured to selectively enclose a food product or the like, comprising:

providing a tray comprising a first side wall, a second side wall, a front wall, a back wall, and a bottom that collectively define a compartment configured to hold a food product or the like, wherein the first side wall and the second side wall of the tray each comprise an enlarged flap that protrudes above the first side wall, the second side wall, the front wall, and the back wall of the tray; and providing a tapered cover comprising a first side wall, a second side wall, a front wall, a back wall, and a top tapered along the first and second cover side walls, wherein the first side wall, the second side wall, the front wall, the back wall, and the tapered top of the tapered cover are substantially coextensive with the tray, and wherein the first side wall and the second side wall of the tapered cover each comprise an enlarged flap that protrudes below the first side wall, the second side wall, the front wall, and the back wall of the tapered cover and that is configured and positioned to interlock with the corresponding enlarged flap of the first side wall and the second side wall of the tray, wherein the enlarged flaps of the tray and the corresponding enlarged flaps of the tapered cover interlock in a side by side configuration.

7. The method of claim 6, wherein each of the enlarged flaps of the tray is disposed substantially adjacent to the front wall of the tray and opposite the bottom.

8. The method of claim 6, wherein each of the enlarged flaps of the tray comprises one or more of substantially straight features, substantially arcuate features, ridges, and notches.

9. The method of claim 6, wherein each of the enlarged flaps of the tapered cover is disposed substantially adjacent to the back wall of the tapered cover and opposite the top.

10. The method of claim 6, wherein each of the enlarged flaps of the tapered cover comprises one or more of substantially straight features, substantially arcuate features, ridges, and notches.

* * * * *